US011678692B2

(12) United States Patent
Ristevski

(10) Patent No.: US 11,678,692 B2
(45) Date of Patent: Jun. 20, 2023

(54) SYSTEM, METHOD, APPARATUS AND COMPOSITION FOR ENHANCING CIGARS

(71) Applicant: Riste Ristevski, Hebron, IN (US)

(72) Inventor: Riste Ristevski, Hebron, IN (US)

( * ) Notice: Subject to any disclaimer, the term of this patent is extended or adjusted under 35 U.S.C. 154(b) by 374 days.

(21) Appl. No.: 16/947,641

(22) Filed: Aug. 11, 2020

(65) Prior Publication Data

US 2021/0045432 A1 Feb. 18, 2021

Related U.S. Application Data

(60) Provisional application No. 62/886,007, filed on Aug. 13, 2019.

(51) Int. Cl.
*A24D 1/00* (2020.01)
*A24B 15/10* (2006.01)

(52) U.S. Cl.
CPC ..... *A24D 1/002* (2013.01); *A24B 15/10* (2013.01)

(58) Field of Classification Search
None
See application file for complete search history.

(56) References Cited

U.S. PATENT DOCUMENTS 3,732,872 A * 5/1973 Lakritz ..... A24C 5/608 131/300
4,619,276 A * 10/1986 Albertson ..... A24C 5/1892 131/362
4,966,170 A * 10/1990 Keritsis ..... A24C 5/1892 131/92
2004/0255965 A1* 12/2004 Perfetti ..... A24B 15/308 131/352
2005/0224136 A1* 10/2005 Hayes ..... A24F 25/00 141/329
2017/0215472 A1* 8/2017 Dube ..... A24D 1/002
2018/0177227 A1* 6/2018 Vouillamoz ..... A24C 1/38

* cited by examiner

*Primary Examiner* — Dennis R Cordray
(74) *Attorney, Agent, or Firm* — Dunlap Bennett & Ludwig. PLLC

(57) ABSTRACT

A system, method, apparatus and composition for enhancing rolled and packed tobacco products. An apparatus of the present invention included a multi-cylinder shipment container to maintain the pack of the tobacco during shipment and an injection needle tip that avoids blockage when injecting the enhancing composition into the cigar. Methods include wrapping and injection methods for enhancing the tobacco product. A composition includes a CBD solution for injection into the cigar at a shipment destination.

14 Claims, 3 Drawing Sheets

SYSTEM, METHOD, APPARATUS AND COMPOSITION FOR ENHANCING CIGARS

CROSS-REFERENCE TO RELATED APPLICATION

This application claims the benefit of priority of U.S. provisional application No. 62/886,007, filed Aug. 13, 2019, the contents of which are herein incorporated by reference.

BACKGROUND OF THE INVENTION

The present invention relates to rolled tobacco products, such as cigars, and more particularly to enhancements for rolled tobacco products.

Tobacco products have been provided in various configurations to convey nicotine to the user. Once such configuration of lasting popularity is the Cigar. Cigars come in varying grades, which are often the product of the tobacco grown in certain geographical locations and the skill, expertise, and techniques employed in the geographical location to roll the cigar.

More recently, it has become popular to enhance cigars with other compositions to supplement the nicotine delivered by the cigar. One such composition is cannabidiol (CBD). For some premium grades of cigars, the laws in a geographical origin of the cigar preclude the supplementation with CBD. Accordingly, the cigars must be shipped from the country of origin without supplementation, requiring the supplement to be added to the cigar after it is delivered to a location where such supplementation is permitted by local laws.

For shipment, it is desirable to maintain the packing density of the tobacco that is rolled within the cigar. Existing bulk shipment methods do not adequately maintain the packing density of the cigars.

It is also desirable for the cigar to be maintained in a controlled humidity environment, typically provided by a humidor. For larger shipment quantities, the techniques and costs associated controlled humidity shipment can be prohibitive, thereby adding to the availability and cost of the cigars.

As can be seen, there is a need for an improved system, method, apparatus and composition for the shipment and enhancement of cigars.

SUMMARY OF THE INVENTION

In one aspect of the present invention, an injection needle for delivery of a liquid supplement to a rolled tobacco product is disclosed. The injection needle includes an elongate cylindrical needle having a sidewall defining an internal fluid delivery channel. A coupling is defined at a base end of the elongate cylindrical needle. The coupling is configured to attach to a delivery device for a pressurized delivery of the liquid supplement through the injection needle. A tobacco penetrating tip is defined at a distal end of the elongate cylindrical needle. The tobacco penetrating tip has a plurality of tips disposed in a spaced apart relation about the sidewall. An arcuate section of the sidewall is defined between adjacent tips of the plurality of penetrating tips. The arcuate section diverges from the adjacent tips towards the base of the needle.

In some embodiments a cutting edge is defined in the sidewall along the arcuate section. The cutting edge may be angled towards an exterior surface of the sidewall. Alternatively, the cutting edge is angled towards an exterior surface of the sidewall.

In some embodiments, the coupling is a syringe coupling and the pressurized delivery device is a syringe.

In other aspects of the invention, a method of adding a liquid supplement to a rolled tobacco product is disclosed. The method includes providing a rolled tobacco product having an outer wrapper and a quantity of a packed tobacco contained within the outer wrapper. The rolled tobacco product has a proximal end, configured for engagement with a user's lips, and a foot end configured for ignition of the packed tobacco, when smoked. An injection needle is inserted into the foot end of the rolled tobacco product to a first delivery depth. The injection needle has a tobacco penetrating tip defined at a distal end of the injection needle, and an internal fluid delivery channel defined by a sidewall. The tobacco penetrating tip includes a plurality of tips disposed in a spaced apart relation at the distal end of the sidewall and an arcuate section of the sidewall is defined between adjacent tips of the plurality of tips. A first quantity of the liquid supplement is delivered through the injection needle into the packed tobacco at the first delivery depth.

In some embodiments, the method includes positioning the injection needle to a second delivery depth within the rolled tobacco product. A second quantity of the liquid supplement is delivered through the injection needle into the packed tobacco at the second delivery depth.

The method may also include removing the injection needle from the rolled tobacco product.

In other embodiments, the method includes packing the rolled tobacco product in a carrier having a plurality of cylindrical tubes disposed in a spaced apart relation. Each of the plurality of cylindrical tubes has an opening to a top face of the carrier. The cylindrical tubes dimensioned to correspond to a length and a diameter of the rolled tobacco product. The carrier is configured to maintain a moisture level of the rolled tobacco product carried in the cylindrical tube.

In some embodiments, the foot end is disposed within the cylindrical tube with the foot end at a top face of the carrier.

The method may also include applying a cellophane wrapper to enclose the rolled tobacco product, wherein the foot end is uncovered by the cellophane wrapper.

In a preferred embodiment, the liquid supplement is a cannabidiol (CBD) solution.

These and other features, aspects and advantages of the present invention will become better understood with reference to the following drawings, description and claims.

DETAILED DESCRIPTION

Figure 1:
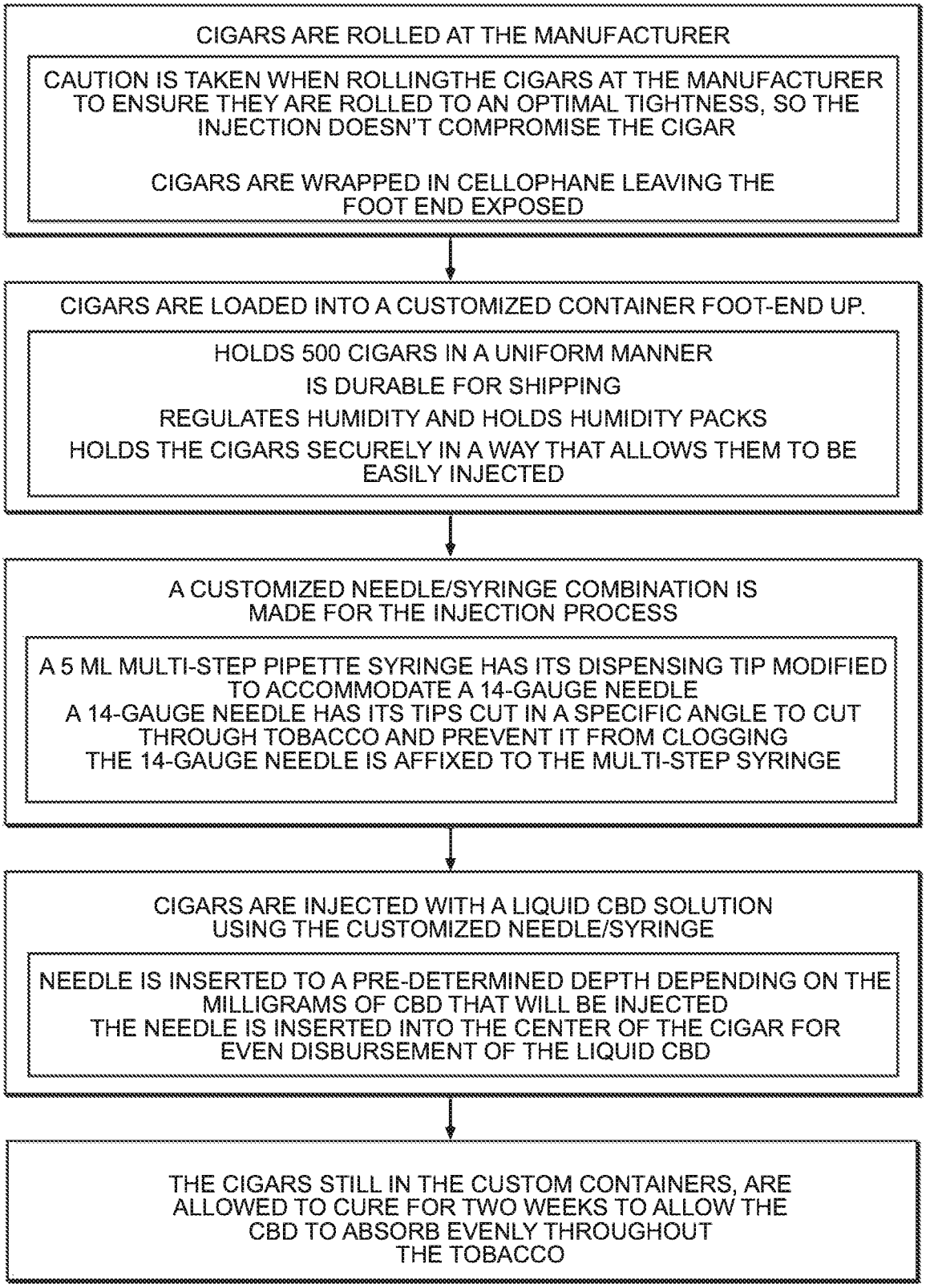
FIG. 1 is a flowchart of a cigar injection process.

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides a system, method, and apparatus for packing and shipping cigars and subsequent injection with an enhancement composition. Aspects of the present invention also include an liquid enhancement composition that is a cannabidiol (CBD) oil 22 containing CBD 22 as the active ingredient, preferably without a tetrahydrocannabinol (THC) or associated terpenes. The liquid enhancement composition may be injected to the tobacco in a premium tobacco product (cigar/cigarette) with an injection process for the cigars disclosed in as a non-limiting example.

According to aspects of the invention, the cigars 10 are preferably wrapped in a cellophane material 12; however, the foot-end 14 of the wrapper is left open. The cigars 10 are then loaded foot-end 14 up into a custom-built carrier 24 that carries a desired quantity of cigars 10. The carrier 24 also provides durability for shipping, regulates humidity, and holds the cigar 10 tightly and uniformly to aid in the injection process.

The injection is performed using a customized tobacco penetrating needle 18. The liquid supplement 22 is delivered through the needle 18 by a delivery device configured to deliver a pressurized source of the liquid supplement 22. In the non-limiting embodiment shown, the delivery device is a syringe 16. Alternatively, the delivery device may include a pump or a gravity feed system to convey the liquid supplement to the needle 18.

Figure 4:
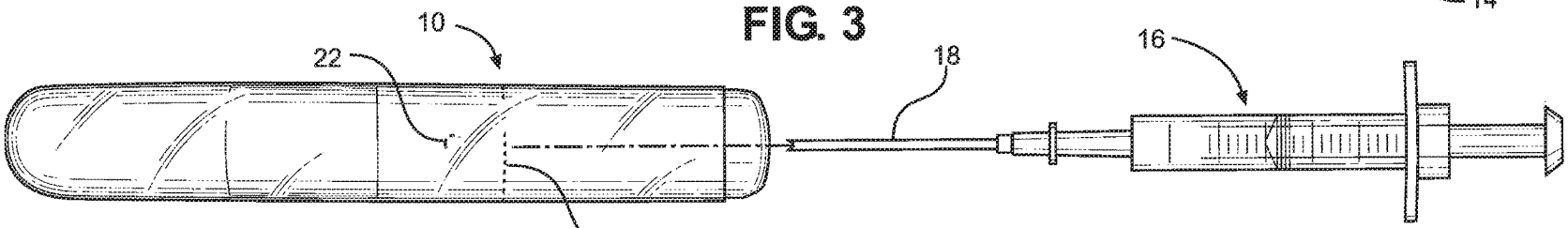
FIG. 4 is a view of the cigar with a syringe aligned for injection.
Figure 5:
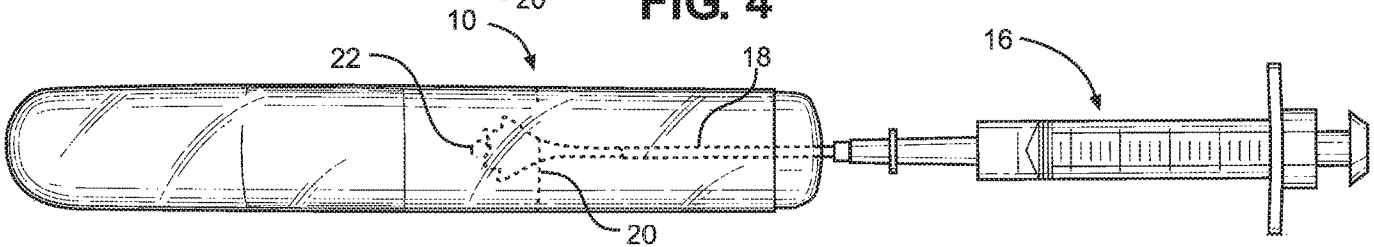
FIG. 5 is a view of the cigar with the syringe inserted into a body of the cigar.

In the embodiment shown in FIGS. 4 and 5, the syringe 16 is a 5 ml multi-step pipette syringe 16 that is modified to accommodate a 14-gauge needle 18 that is 1.5" long. As seen in reference to FIGS. 6 and 7, the needle 18 has a custom cut tip that allows it to cut through tobacco leaves without clogging or distorting the cigar 10. The needle 18 may be permanently affixed to the delivery device.

The needle 18/syringe 16 combination is filled with a liquid CBD solution 22 and each cigar 10 is injected. The needle 18 is inserted to a specific depth 20 depending on the milligrams of CBD 22 is required. A liquid CBD solution 22 is injected into the cigar 10. The amount of liquid CBD 22 is determined by the milligrams required. After injection, the cigar 10 are left to cure and absorb the liquid CBD solution 22.

Figure 2:
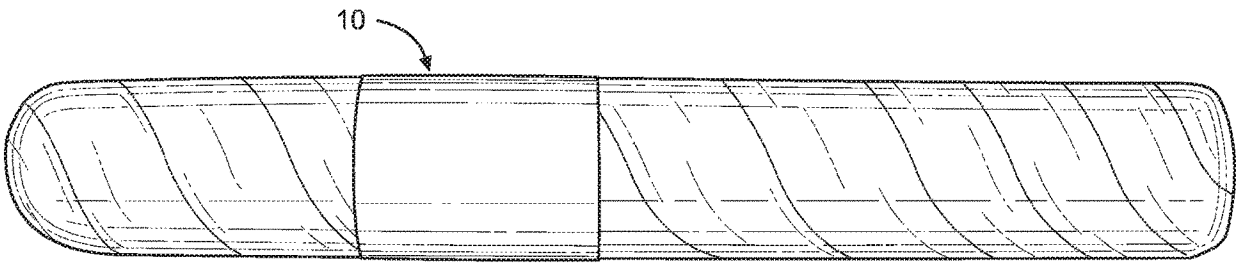
FIG. 2 is a view of a cigar.
Figure 3:
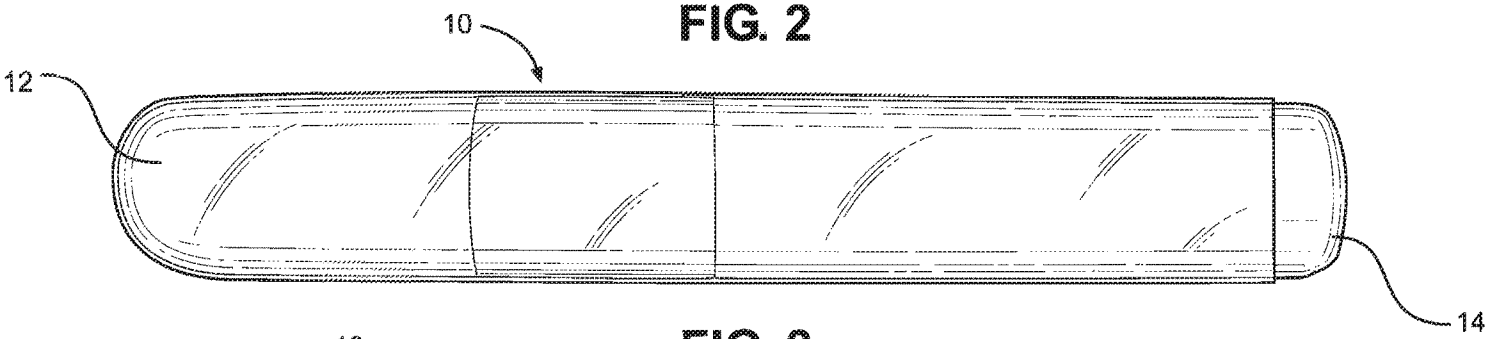
FIG. 3 is a view of a cigar wrapped in cellophane with the end exposed.

A method of CBD 22 infusion of a cigar 10 may be performed according to the following steps:

A plurality of cigars 10, such as shown in reference to FIGS. 2 and 3, are rolled by a cigar manufacturer. Caution is taken when rolling the cigars 10 to ensure they are rolled to an optimal tightness, so that a subsequent CBD 22 injection doesn't compromise the integrity of the rolled cigar 10. The cigars 10 are then wrapped in cellophane material 12, leaving the foot end 14 exposed.

Figure 8:
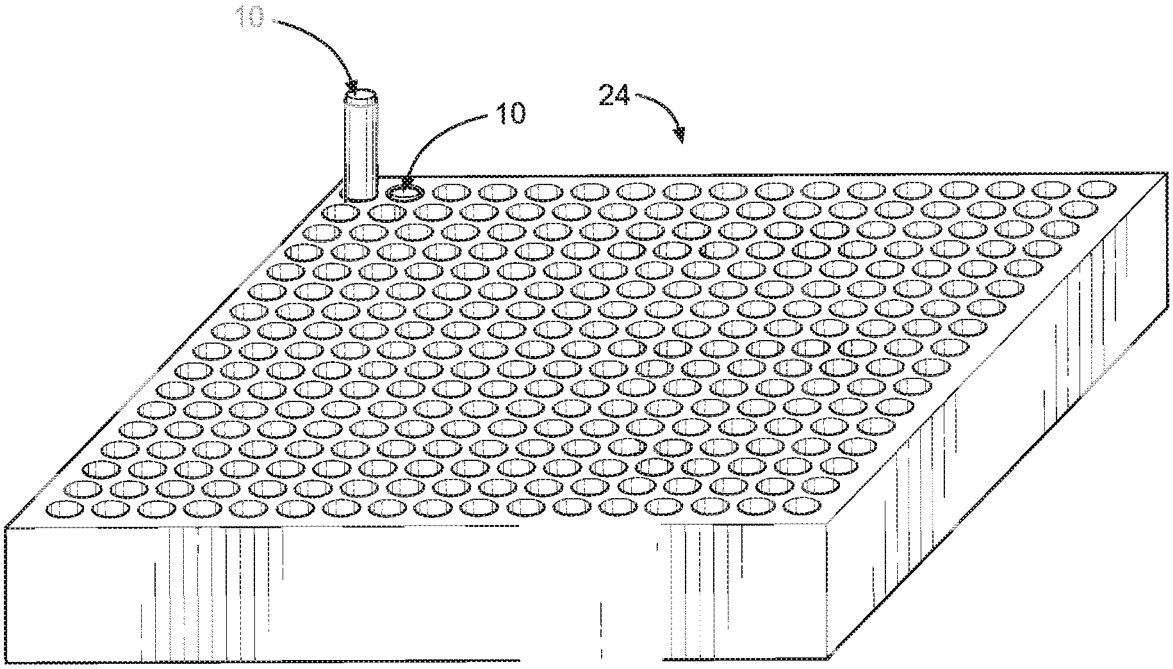
FIG. 8 is a perspective view of a cigar carrier and insertion of cigars therein.

The plurality of cigars 10 are loaded into a customized carrier 24, shown in reference to FIG. 8, with a foot-end 14 up. The carrier 24 has a plurality of cylindrical sleeves disposed in a top surface of the carrier 24 in a spaced apart manner. The quantity of sleeves corresponding to a desired shipment quantity. By way of non-limiting example, the carrier 24 may be configured to holds 500 cigars 10 in a uniform manner, is durable for shipping. Containment of the cigar 10 within the sleeves regulates humidity and holds humidity packs. The carrier 24 also holds the cigars 10 securely in a way that allows them to be easily injected at a receiving destination of the shipment.

A customized needle 18/syringe 16 combination may be made for the injection process. The needle 18/syringe 16 combination may include a 5 ml multi-step pipette syringe 16, such as shown in FIGS. 3-5 having its dispensing tip modified to accommodate a 14-gauge needle 18. The 14-gauge needle 18 has its tip cut to a specific shape that cuts through tobacco and prevents the injection needle 18 from clogging.

Figure 6:
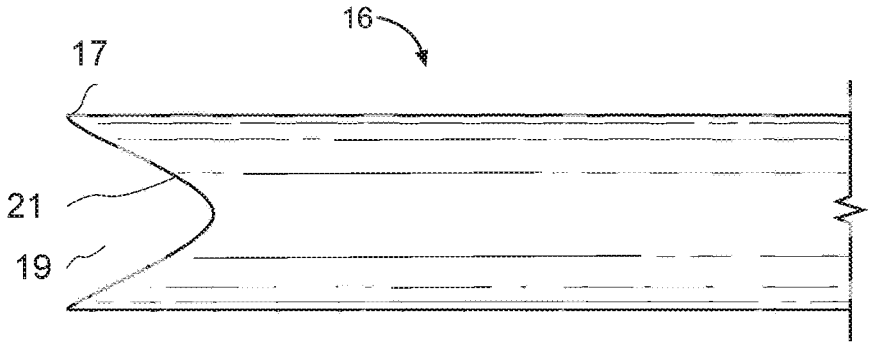
FIG. 6 is a detail side elevation view of an injection needle tip.
Figure 7:
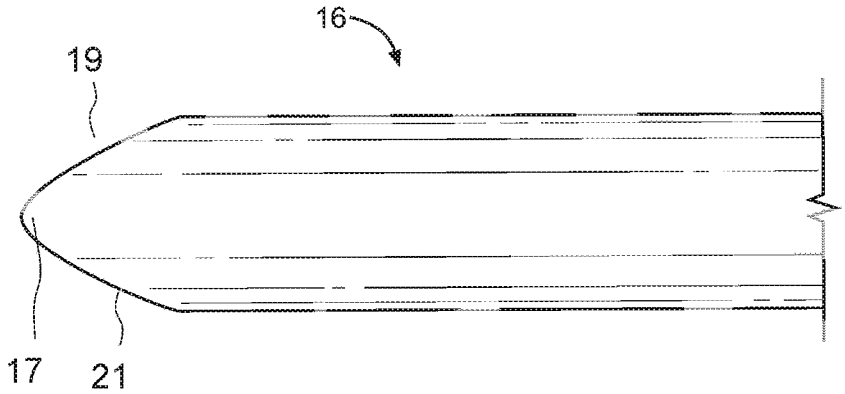
FIG. 7 is a detail top plan view of the injection needle tip.

Referring again to the drawings of FIGS. 6 and 7, the tip includes at least two penetrating tips 17 disposed at opposed ends of the needle sidewall. An arcuate section 19 diverges from the tips 17 towards a base of the needle 18. Preferably, the 14-gauge needle 18 is permanently affixed to the multi-step syringe 16. The tip 17 of the needle 18 is shaped to cut through the tobacco. This specific shape also minimizes clogging when compared to other shapes that were tested. A cutting edge 21 may be defined by a bevel on the inner surface of the needle 18 sidewall. The curve of the cutting edge 21 and the rounded points of the tips 17 of a non-cutting edge help to prevent clogging.

The cigars 10 are injected with a liquid CBD solution 22 using the customized needle 18/syringe 16. The needle 18 is inserted to a pre-determined depth 20 depending the volume or quantity of CBD 22 that will be injected into the cigar 10. The needle 18 is inserted into the center of the cigar 10 for even disbursement of the liquid CBD 22 to the tobacco carried in the cigar 10.

The cigars 10, still carried in the custom carrier 24, are allowed to cure for two weeks to allow the liquid CBD 22 to absorb evenly though out the tobacco.

A CBD solution 22 according to aspects of the present used to inject the cigars 10 is comprised of the following elements:

A CBD (THC-free CBD distillate or CBD Isolate are used depending on a desired formulation), Polyethylene Glycol 400 (as the liquid solution. (USP, GRAS, Food grade), and Terpene Blend (terpene blend may be made using certified organic terpene isolates. Blends are created depending on formulation).

The CBD solution 22 may be formulated according to the following method steps:

1. Charge Polyethylene Glycol 400 to a suitable glass container.

Note: Size of container depends on the amount of solution being made.

2. Heat the Polyethylene Glycol 400 with agitation to not more than 100° C., with a target temperature of 80° C.

3. Charge CBD to Polyethylene Glycol 400.

Notes: The amount of CBD depends on the CBD concentration of the formulation being made. i.e. 20 mg, 50 mg, 100 mg, etc. The quantity of CBD 22 used is determined by formulation; such as one or more of a THC-free distillate or a CBD Isolate.

4. Mix the solution until the CBD is fully dissolved while maintaining the target temperature.

5. Remove the CBD solution 22 from heat and let cool to room temperature.

6. Charge a terpene blend to the mixed CBD solution 22.

Note: The terpene blend used is determined by formulation.

7. Mix to fully homogenize, typically for not less than 10 min.

8. Filter the solution to ensure any particulate is removed and collect in clean, suitable container.

9. Store the CBD solution at room temperature and out of direct light.

As seen in reference to FIG. 1, a method of treating a cigar 10 with a liquid supplement is described. In the non-limiting embodiment shown, the liquid supplement is a CBD solution. The steps below are followed when injecting the CBD solution into the cigar 10:

1. Charge the required amount of CBD solution to a suitable container.

Note: Amount is determined on batch size.

2. Heat the CBD solution with agitation to approximately 40° C. Note: This aids in the injection process by increasing viscosity.

3. Fill syringe 16 with CBD solution.

4. Insert needle 18 1.5 inches into the foot-end 14 of the cigar 10.

5. Pull needle 18 out 0.5 inch, leaving the needle 18 in 1 inch. Note: This creates a small pocket of CBD disposed between 1 to 1.5 inches in from the foot-end 14 of the cigar 10.

6. Inject CBD solution. Note: Amount of CBD solution injected is determined by the formulation.

7. Remove needle 18 completely from cigar 10.

As will be appreciated, the definition of a cigar 10 is based in part on the size of cylinder to which the tobacco is rolled. The system, methods, apparatus, and composition of the present invention may be applied to other rolled and smoked tobacco products, such as cigarettes, mini-cigarillos, and the like.

It should be understood, of course, that the foregoing relates to exemplary embodiments of the invention and that modifications may be made without departing from the spirit and scope of the invention as set forth in the following claims.

What is claimed is:

1. A method of adding a liquid supplement to a rolled tobacco product, comprising:

providing a rolled tobacco product having an outer wrapper and a quantity of a packed tobacco contained within the outer wrapper, the rolled tobacco product having a length, a diameter, a proximal end, configured for engagement with a user's lips, and a foot end configured for ignition of the packed tobacco and the outer wrapper, when smoked;

inserting an injection needle into the foot end of the rolled tobacco product to a first delivery depth within the rolled tobacco product, the injection needle terminating in a dispensing tip defined at a distal end of the injection needle and fluidly coupled to an internal fluid delivery channel defined by a sidewall of the injection needle, the dispensing tip comprising a plurality of penetrating tips spaced circumferentially around a distal end of the sidewall so that a distal edge of the sidewall defines an arcuate section between adjacent penetrating tips.

2. The method of claim 1, further comprising:

positioning the injection needle to a second delivery depth within the rolled tobacco product; and delivering a predetermined quantity of the liquid supplement through the injection needle into the packed tobacco.

3. The method of claim 1, further comprising:

removing the injection needle from the rolled tobacco product.

4. The method of claim 1, further comprising:

packing the rolled tobacco product in a carrier having a plurality of cylindrical tubes disposed in a spaced apart relation, each of the plurality of cylindrical tubes having an opening to a top face of the carrier, each of the plurality of cylindrical tubes dimensioned to correspond to the length and the diameter of the rolled tobacco product.

5. The method of claim 4, further comprising:

carrying the rolled tobacco product in the plurality of cylindrical tubes, wherein the carrier is configured to maintain a moisture level of the rolled tobacco product carried in the plurality of cylindrical tubes.

6. The method of claim 4, wherein the foot end is disposed within the plurality of cylindrical tubes with the foot end at the top face of the carrier.

7. The method of claim 1, further comprising:

applying a cellophane wrapper to enclose the rolled tobacco product, wherein the foot end is uncovered by the cellophane wrapper.

8. The method of claim 1, wherein the liquid supplement is a cannabidiol (CBD) solution.

9. A method of adding a liquid supplement to a rolled tobacco product, comprising:

providing a rolled tobacco product having an outer wrapper and a quantity of a packed tobacco contained within the outer wrapper, the rolled tobacco product having a proximal end, configured for engagement with a user's lips, and a foot end configured for ignition of the packed tobacco and the outer wrapper, when smoked;

inserting the rolled tobacco product into a carrier, the carrier having a plurality of cylindrical orifices, each cylindrical orifice dimensioned to contain the rolled tobacco product in close proximity to an interior sidewall of the cylindrical orifice, wherein the foot end is exposed proximal to a top surface of the carrier;

heating the liquid supplement to a temperature of approximately 40° C.;

agitating the liquid supplement while heating;

inserting an injection needle into the foot end of the rolled tobacco product to a first predetermined depth, wherein the first predetermined depth is about 1.5 inches; and withdrawing the injection needle from the rolled tobacco product to a second predetermined depth.

10. The method of claim 9, wherein the second predetermined depth is about 1 inch.

11. The method of claim 9, further comprising:

injecting a predetermined quantity of the liquid supplement through the injection needle into the rolled tobacco product based on the first predetermined depth.

12. The method of claim 11, further comprising:

removing the injection needle from the rolled tobacco product.

13. The method of claim 11, wherein the liquid supplement is a cannabidiol (CBD) solution.

14. The method of claim 13, wherein the CBD solution further comprises a polyethylene glycol and a terpene blend.

* * * * *